US005832767A

United States Patent [19]

Wompner et al.

[11] Patent Number: 5,832,767

[45] Date of Patent: Nov. 10, 1998

[54] PROCESS FOR EXTRUDING A SECTION OR THE LIKE FROM AN INGOT AND A DEVICE FOR THAT PURPOSE

[75] Inventors: Diethelm Wompner, Bodman-Ludwigshafen; Adolf Ames, Hilzingen-Duchtlingen; Ulf Hodel, Engen; Gregor Rotzinger, Singen-Friedingen, all of Germany

[73] Assignee: Alusuisse Technology & Management Ltd., Switzerland

[21] Appl. No.: 797,304

[22] Filed: Feb. 7, 1997

Related U.S. Application Data

[63] Continuation-in-part of Ser. No. 778,951, Jan. 6, 1997, abandoned.

[51] Int. Cl.[6] ..... B21C 23/00

[52] U.S. Cl. ..... 72/255

[58] Field of Search ..... 72/254, 255, 270, 72/272, 273.5

[56] References Cited

U.S. PATENT DOCUMENTS

| | | | |
|---|---|---|---|
| 4,365,497 | 12/1982 | Asari | 72/255 |
| 4,379,398 | 4/1983 | Asari et al. | 72/254 |
| 4,735,070 | 4/1988 | Mastrot et al. | 72/254 |

FOREIGN PATENT DOCUMENTS

| | | | |
|---|---|---|---|
| 56-102312 | 8/1981 | Japan | 72/272 |
| 5-138236 | 6/1993 | Japan | 72/255 |
| 5-261429 | 10/1993 | Japan | 72/255 |
| 6-71334 | 3/1994 | Japan | 72/255 |
| 751461 | 7/1980 | U.S.S.R. | 72/272 |

*Primary Examiner*—Joseph J. Hail, III
*Assistant Examiner*—Ed Tolan
*Attorney, Agent, or Firm*—Bachman & LaPointe, P.C.

[57] ABSTRACT

A process for extruding a section or the like body from an ingot is such that an ingot is introduced into a bore of a container and, by means of an extrusion stem, is fed in the direction of extrusion into a shape-giving opening in a die. Before the ingot enters the die opening, it is pushed out of the container by an amount corresponding to the width (t) of a collar whereupon a disk-shaped slice is sheared off the free end of the ingot and removed. The free end of the ingot is then pushed onto the die opening. In order to carry out this process, a shearing tool is provided after the end of the container facing the die and a movable shearing blade positioned over that entrance to the container bore. The disk-shaped slice should preferably be sheared away together with a residual butt of the previously extruded ingot which faces away from the die. To that end, a shearing tool with two shearing blades is provided and can be moved radially with respect to the longitudinal axis (A) of the container bore.

19 Claims, 8 Drawing Sheets

PROCESS FOR EXTRUDING A SECTION OR THE LIKE FROM AN INGOT AND A DEVICE FOR THAT PURPOSE

CROSS-REFERENCE TO RELATED APPLICATION

This application is a Continuation-In-Part of U.S. patent application Ser. No. 08/778,951, filed Jan. 6, 1997, now abandoned.

BACKGROUND OF THE INVENTION

The invention relates to a process for extruding a section or the like from an ingot which is introduced into the bore of a container and, by means of an extrusion stem, fed in the direction of extrusion into a shape-giving opening in a die. Furthermore, the invention also relates to a device which is specially suited for that purpose.

During the extrusion process, a material which is in a ductile state, with regard to metals, materials such as non-ferrous metals, sintered metals or steel but in particular an aluminum alloy, a heated ingot or rolled length of material is pressed in the direction of extrusion by means of an extrusion stem, or in the case of hydrostatic extrusion, by a fluid, through one or more openings in a die. In the case of direct or forward extrusion, the stem moves in the direction of the die opening, in the same direction as the resultant section. In indirect or backward extrusion, the material is moved counter to the direction of movement of the stem, through a die which is mounted on the hollow stem.

When, in the case of direct extrusion, the end of the stem has reached the die, a so-called ingot butt, which is of more or less inferior quality material, is left at the back of the die, i.e., between it and the stem. This butt is normally removed by a shearing tool, which can move radially with respect to the die, before the next ingot can be pushed into the container and onto the die face by the stem, which in the meantime has been withdrawn, thus enabling the actual extrusion process to continue.

Metal ingots, especially ingots of aluminum alloys, are coated with contaminants, for example, residual lubricant, and an oxide layer. Experience shows that the oxide particles on the end of the ingot are extremely detrimental when they become incorporated in the resultant section; the zone of contaminating oxide inclusions in the section is relatively long, depending on the shape of the section and the extrusion speed. Consequently, as quality requirements are increasing, manufacturers are forced to scrap increasingly longer lengths of section. The result is diminished output and lower cost efficiency. Numerous attempts have been made to eliminate this problem but without success.

SUMMARY OF THE INVENTION

In view of the above, the object of the present invention is to eliminate the contamination zone arising between two neighboring ingots or billets, in particular when extruding aluminum alloys.

That objective is achieved by way of the invention.

In accordance with the invention, before the front end of the ingot enters the die opening, the ingot is first compressed and pushed a small distance, e.g., 10 mm, out of the container in the direction of extrusion; following this, a disk-shaped slice is sheared away from the free end of the ingot and removed. The free end of the ingot is then advanced to the die opening or to the rear end of the section being produced.

By removing this front part of the ingot, the oxide layer there is also removed, with the result that, on the condition that the now virgin ingot end is rapidly advanced to the die, there is no fear of contamination by oxide particles nor of having to sacrifice extended lengths of section.

In order to eliminate any delay between the shearing process and the continuation of the extrusion process, the removal of the ingot end should take place at the same time as the normal shearing of the ingot butt on the die face. To that end, the die and the container should be moved away from each other along their common axis after an ingot has been extruded; when their neighboring ends have been fixed together, the shearing of the ingot butt and the ingot end can then take place.

Of particular importance, and according to the invention, is the shearing of the new ingot face on extruding a section, the cross-section of which is at least partially larger than that of the ingot itself. Using the so-called spreader technique a large and wide section is extruded from an ingot of small diameter, whereby the material from the ingot is spread out in cross-section in a pre-die chamber before entering the actual die opening; this spreading of the material takes place in predetermined regions, if desired, accompanied by narrowing within that cross-sectional contour to create a narrow cross-section also.

The device according to the invention by means of which the process of the invention may be carried out, is characterized in that a shearing tool is provided at the end of the container facing the die; the blade of the shearing tool, or a suitable means of separation, can be passed over the exit from the container bore. In that connection, it is advantageous for the container, which is moveable along its axis, to be fixed at the radial line of displacement of the shearing tool.

As already mentioned, the time between removing the ingot end facing the die and advancing the sheared ingot face to the end of the section being produced should be kept as short as possible. In order to achieve this, it should be possible to fix the distance between the neighboring end faces of container and die; in the resultant gap of exactly predetermined width a shear with two blades is activated, simultaneously removing the residual butt of the extruded ingot and the front end of the next ingot. These slices of ingot may be returned for remelting, the harmful oxide particles removed and the material reused for production purposes.

According to another feature of the invention, the distance between the two shearing blades is adjustable; any deviation from the intended gap size, determined e.g. by monitoring with a laser beam, can then be corrected.

A means for guiding the shearing facility may usefully be provided on the front face of the container, especially when a conventional, ring-shaped length of container sleeve projects out of the container bore. According to the invention, the pre-die chamber, situated upstream of the die for the purposes of extruding an aluminum ingot using the so-called spreader method, increases in size from the diameter of the container bore to the die opening at least in one plane running in the direction of extrusion which is defined by an axis running transverse to the direction of extrusion.

In one version of this pre-die chamber its cross-section tapers in the direction on both sides of another axis which crosses the first axis. In this region, the amount of material required is less than that offered by the ingot being extruded; the excess material is diverted to the other axis.

It has been found to be particularly favorable to arrange both axes perpendicular to one another and to arranged them as lines of symmetry; as a result, the distribution of the excess material is uniform.

An advantageous version of the device is such that a spacer facility is provided at the gap between the die and the container and can be advanced into and retracted from that gap transverse to the extrusion direction, and the die and container may be laid against that spacer. The intention here is to be able to position the container/die pair quickly and without problem.

A preferred version of the spacer facility features at least one stop plate or the like insert which runs in the direction of extrusion and whose edges, arranged transverse to the direction of extrusion, act as stops for the die and container. In particular, two stop plates should be joined by at least one yoke and connected by this to a movable set of rods or the like drive mechanism, whereby the stop plates then flank the separating facility/facilities.

The spacer facility is moved independent of the shearing facility and is moved into the gap between the container and the die, after which the container is moved up to the stop plate until this rests on the other side from the die. It is therefore no longer necessary to lock the container in place, a mechanical, time consuming handling procedure.

If a shearing facility featuring two shears which are spaced apart, is to be provided, then the width of the stop plates corresponds approximately to the width of the shearing device containing the two shearing blades, i.e., the shearing device is e.g. 1 mm narrower than the stop plate(s), in order to have enough to play for the shearing blades or the shearing operation; the spacer facility and shearing facility are to be moved independent of each other, as the latter should move unhindered into the then stationary spacer facility to perform the shearing operation.

The independence of the shearing facility from the spacer facility holds also for other designs of the latter. This spacer facility is in the form a channel-shaped section which is open at least at one end and features flanges and a base which act as stops for the die and container, the flanges in cross-section running parallel to the direction of extrusion and in the operating or shearing position stand on both sides of the ingot butt. In this operating position, the arrangement of the container/channel-shaped section/die before shearing off the ingot butt, which is not always completely flat, is advantageously in the interior of the section so that the outer face of the channel base is facing towards the ingot or its end slice.

It has therefore been found favorable to provide a recess on the outside of the channel base to accommodate the end slice of the ingot facing the direction of extrusion. Normally it suffices if this recess is about 10 mm deep.

In order to make it possible for the shearing blades to be introduced into the interior of the section and the recess, this is provided with an opening for each shearing blade on the shearing facility, and both openings lie on the long edges of the channel-shaped section on opposite sides of the section.

In the case of the shearing facility with two shearing blades spaced a distance apart, these blades are of different length, this in order to ensure that they slice into the ingot butt and ingot front end slice at different moments of time. Thereby, it is preferable for the shearing blade which is next to the die to be longer than the blade next to the container.

BRIEF DESCRIPTION OF PREFERRED EMBODIMENTS

Further advantages, features and details of the invention are revealed in the following description of preferred exemplified embodiments and with the aid of the drawings which show in:

FIG. 1 a perspective view of part of an extrusion press with horizontal stem;

FIG. 2 an enlarged view of part of FIG. 1;

FIG. 3 a longitudinal section through a sketched container with stem upstream and the die tool downstream, both with respect to the direction of extrusion;

FIGS. 4 & 5 the representation shown in FIG. 3 but with container and stem in different positions;

FIGS. 6 & 7 different versions of shearing facilities situated between the container and the die tool;

FIG. 8 a part of an enlarged side elevation of a die tool with pre-die chamber for extruding using so-called spreader technology;

FIG. 9 a sketch of the, with respect to the extrusion direction, pre-die chamber complete with die opening;

FIGS. 10 & 11 cross-section through the pre-die chamber along line Q and line M in FIG. 9;

FIG. 12 a sketch of the theoretical surface for material flow in the die;

FIGS. 13 & 14 different versions of shearing facilities situated between the container and the die tool;

FIG. 15 an enlarged end view of the shearing facility shown in FIG. 13;

FIG. 16 a perspective view of a double bladed shearing tool with spacer for container and die;

FIG. 17 a representation of container and die corresponding to that in FIG. 13 with another spacer arranged between them; and FIG. 18 an enlarged perspective view of the spacer shown in FIG. 17.

DETAILED DESCRIPTION

Figure 1:
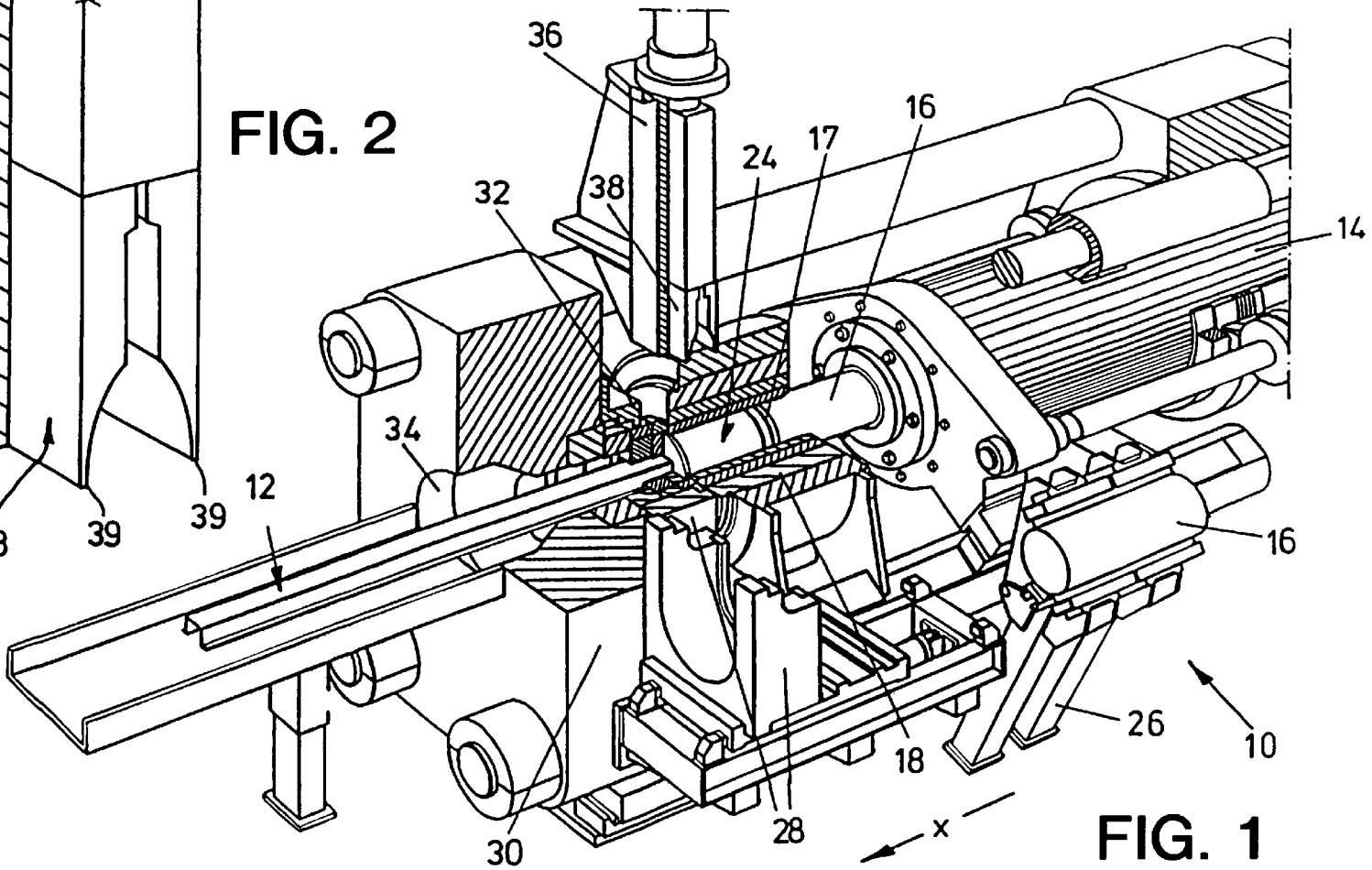
Figure 2:
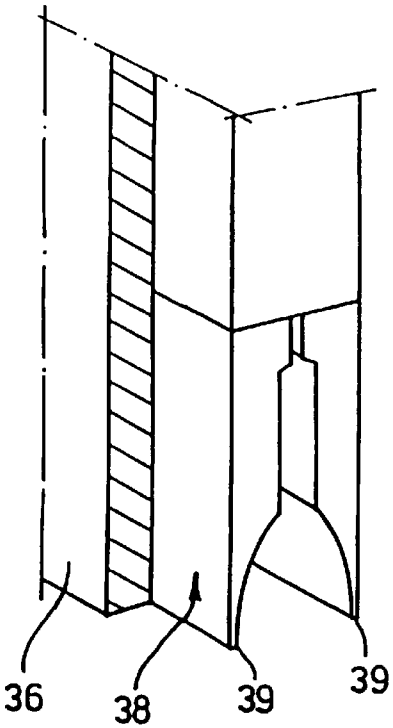

An extrusion press 10 for direct extrusion of sections 12 features, as shown in FIG. 1, on a main cylinder 14, a pressing stem 16 which lies along the longitudinal axis A of the bore 19 running through a container 18. The diameter d of a dummy block 17 at the free end face of the stem 16 is slightly smaller than the free bore diameter $d_1$ with the result that the stem 16 is able to penetrate the container bore. The mentioned bore diameter $d_1$ is delimited by the inner surface 20 of a sleeve 21 inserted in the container 18 or its bore 19. In the following, the space inside this sleeve 21 is called the container bore 22.

The maximum distance between a front 23 of the container and the dummy block 17 in the inactive position of the stem 16, which is not shown here, is such that a billet or ingot 24 of light weight metal, in particular of preheated aluminum alloy, can be aligned by means of a loader 26 in front of the container bore 22 and pushed in the direction of extrusion x by the stem 16 into the container bore 22.

Close to a container end face $\mathbf{23}_a$, remote from the stem 16, is the shape-giving die 32 resting in a die holder 28 on an extrusion platen 30. With respect to the direction of extrusion x, this is followed by a run-out channel 34 in the platen 30 through which the resulting section 12 with the shape endowed by the contour 31 of the die 32 is removed.

Above the end face $\mathbf{23}_a$ of the container is, as shown in FIG. 1, a jacking system 36 for a shearing facility 38 which moves radially to a gap 40 between the container 18 and the die 32.

Figure 3:
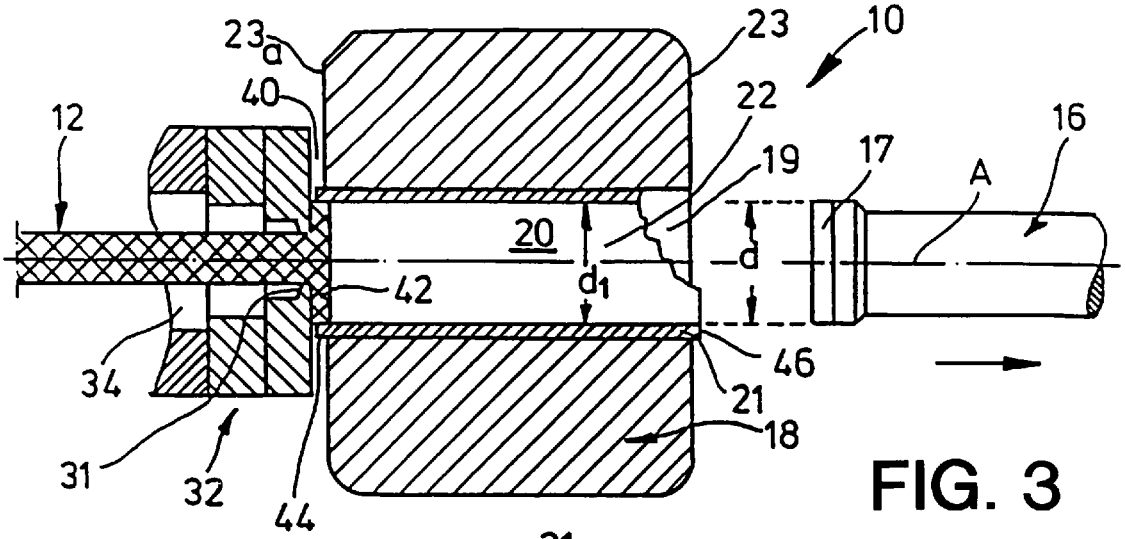
Figure 4:
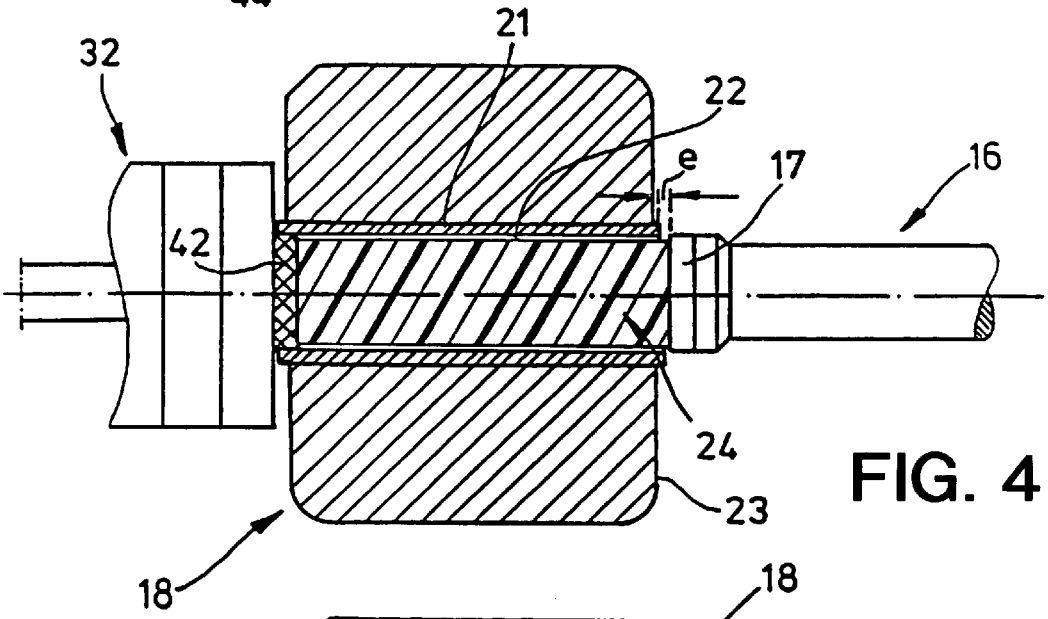

At the end of the extrusion process, shown in FIG. 3, a so-called ingot butt 42 forms at the end of the container bore 22 away from the stem 16. In FIG. 3, the dummy block 17 has been drawn back from the ingot butt 42. As a result of a collar 44 formed by the projecting length of the container sleeve 21, the die face 33 remains a distance from the front end $\mathbf{23}_a$ of the container. Also at the rear container end 23, the container bore 22 surrounds a ring-shaped collar 46 which acts as a projecting length of the container sleeve 21.

On inserting a new ingot 24, the free end of the ingot butt 42 is, e.g., about 80 mm thick. The back end distance e of ingot material 24 amounts to, at most, 20 mm.

Figure 5:
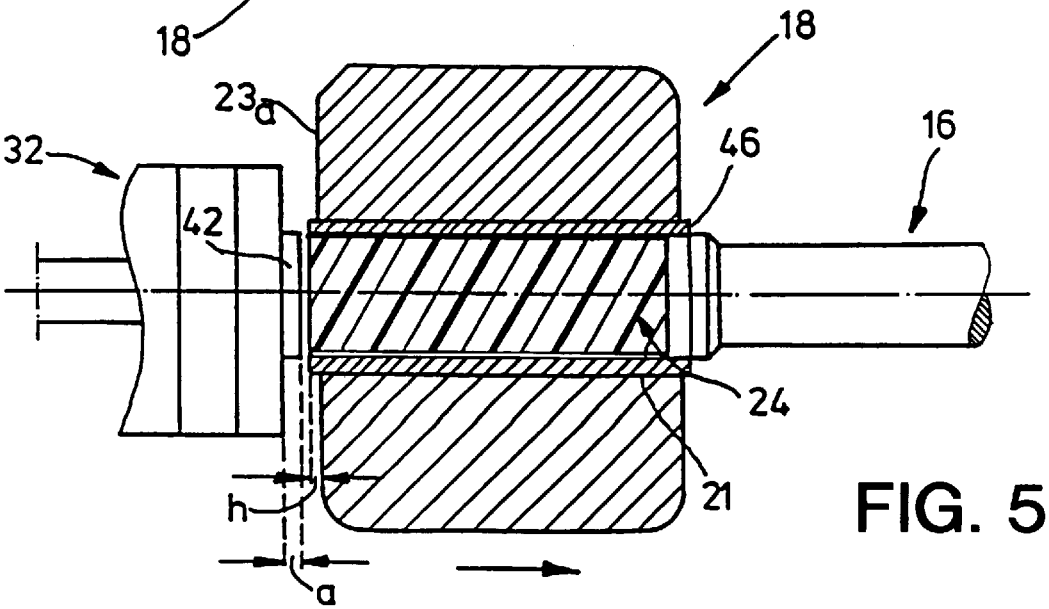

The container 18 is then drawn back until the butt 42 is standing free (FIG. 5). If the ingot 24, as shown in FIG. 6, projects out a collar length t of about 10 mm beyond the collar 44, then compressed by the stem 16; it should then not be possible for the ingot 24 to be displaced by the shearing tool 38 as a result of a subsequent shearing step which is still to be described.

Before the shearing process takes place, the container 18 is drawn counter to the direction of extrusion x until the rear face 33 of the die or of the die 32 itself is a distance n from the end face $\mathbf{23}_a$ of the container 18. The container 18 and the die 32 are temporarily fixed in this position.

Figure 6:
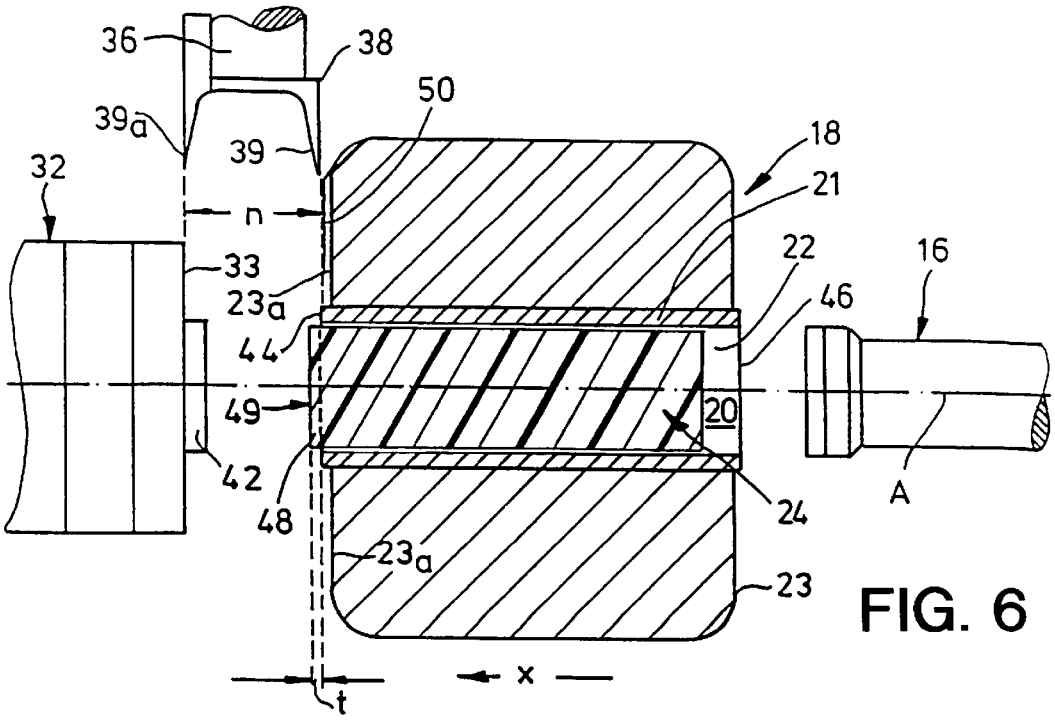

By lowering a pair of shearing blades 39, $\mathbf{39}_a$ of the shearing tool 38, as shown in FIG. 6, the butt 42 and an end slice 48 of projecting length t of ingot 24 are removed simultaneously, and with that the end face 49 at the downstream end of the ingot 24, prior to the mentioned shearing step an oxide layer had formed at the end face 49, the oxide particles of which would have created undesirable impurities in the resultant section 12 had they not been removed.

In order to insure accurate alignment of the shearing tool 38, vertical alignment strips 50 are provided on the end face $\mathbf{23}_a$ of the container 18 above the collar 44; the thickness of the alignment strips 50 corresponds to the thickness h of the collar 44.

Figure 7:
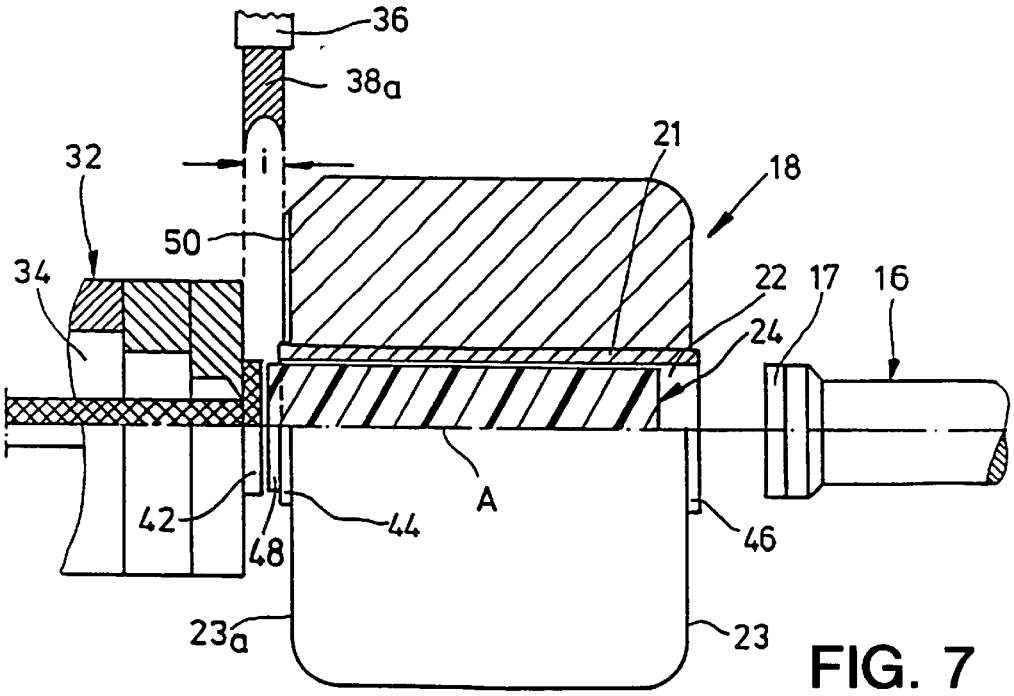

In the version shown in FIG. 7, the butt 42 and the ingot end face 49 remain close to each other so that the width i of the shearing blade $\mathbf{38}_a$ may be kept very small. As a result, the distance between the new, oxide-free ingot end and the section end simultaneously separated from the ingot butt 42 is extremely short.

After the shearing operation, the container 18 is again moved towards the die 32 and the extrusion process can begin again from the start.

Figure 9:
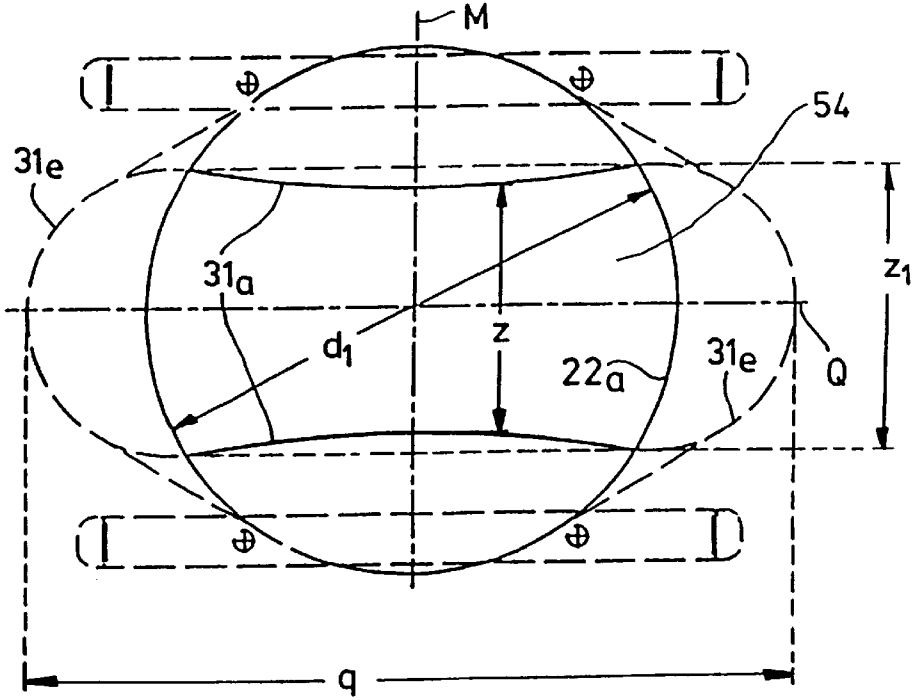
Figure 8:
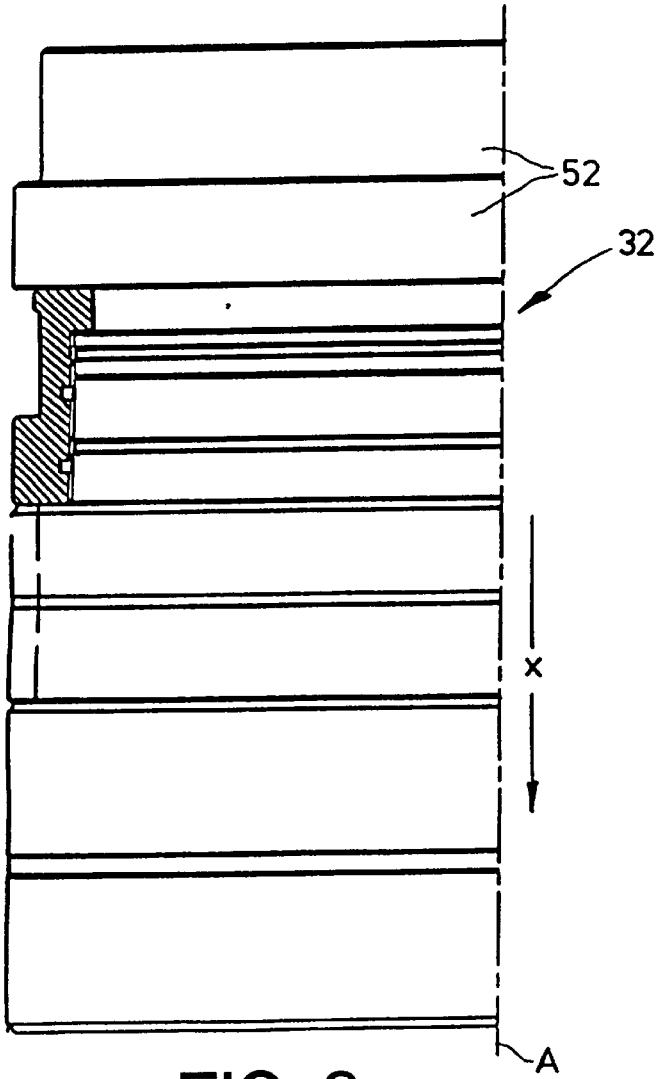

As viewed in the direction of extrusion x, the die 32 according to the version shown in FIG. 8 features a die ring 52 with an axial length b of 270 mm forming a pre-die chamber 54 into which the ductile ingot material is introduced and from there into the, here, slit-shaped opening 31*e* the horizontal longitudinal dimension q of which is, e.g., at 750 mm significantly larger than the bore diameter $d_1$ of 520 mm. The height z of the die opening 31*a* in which a central plane in the direction of extrusion x of a determining vertical central axis M measures only 240 mm. From the central axis M, which, as does the transverse axis q to it, represents a line of symmetry, the die opening 31*e* increases in dimension on both sides to 280 mm as the largest height $z_1$. The latter is shown in FIG. 9 as defined by the contour $\mathbf{22}_a$ of the container bore 22 from the two points of intersection of the longitudinal contours $\mathbf{31}_a$ of die opening 31*e*. Outside thereof the end contour of the die opening 31*e* is partially circular in shape.

Figure 10:
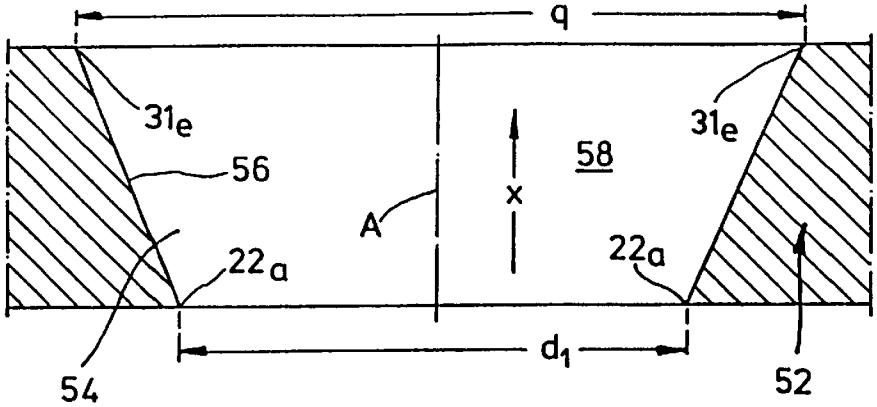
Figure 11:
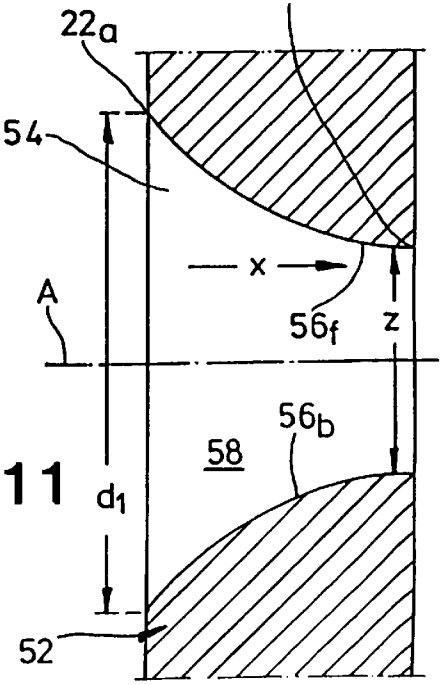
Figure 12:
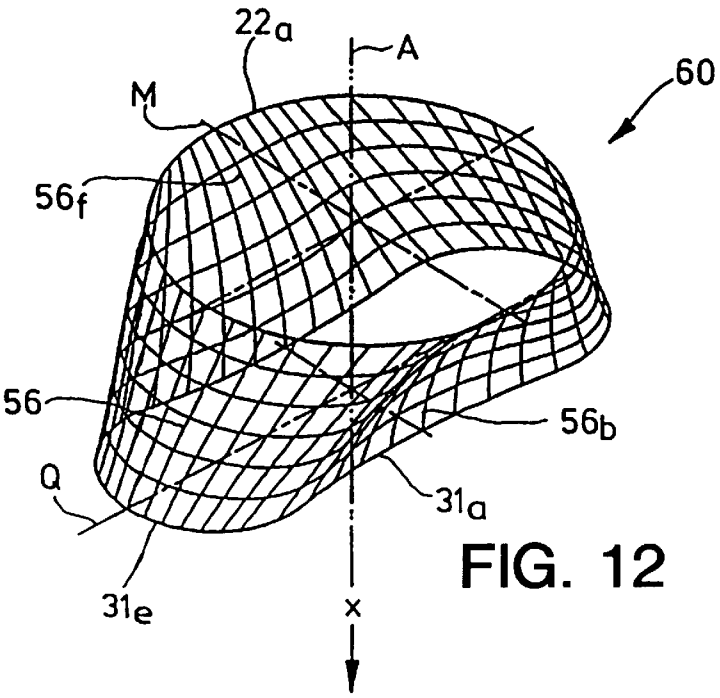

The contour 56 at the side of the chamber wall 58, as shown in FIG. 10, is a straight line connecting the contour $\mathbf{22}_a$ of the container bore 22; the curved, part-circle-shaped base contour $\mathbf{56}_b$ and the counter-facing curved roof contour 56*f* delimit, as shown in FIG. 11, a cone which tapers towards the die opening 31*e*. The three-dimensional shape of the chamber wall 58 is illustrated by the surface 60 shown in FIG. 12.

Creating large, wide sections 12 from a relatively narrow container bore 22 is achieved by means of the so-called spreader technique. Using the latter method and thanks to the pre-die chamber 54, it is possible to manufacture such sections from round containers 18 using dies 32 designed for rectangular containers.

Figure 13:
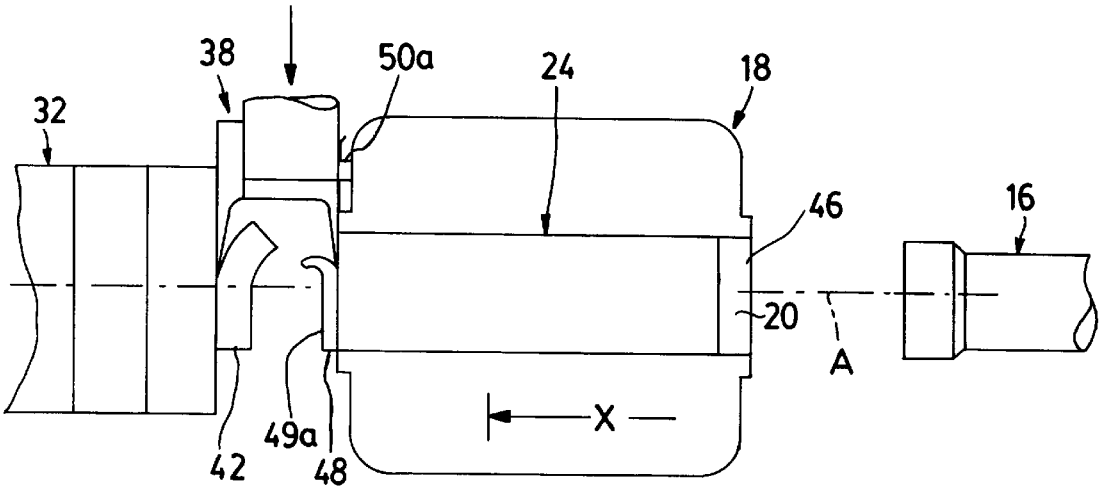
Figure 15:
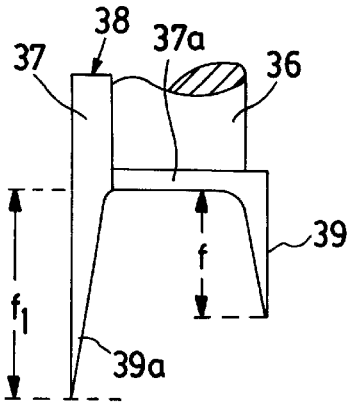

The double bladed shearing facility 38, preferably comprising a blade plate 37 near the die 32 and a blade flange $\mathbf{37}_a$ attached to the latter, shows in FIGS. 13, 15 shearing blades 39, $\mathbf{39}_a$ of different length f, $f_1$. The blade $\mathbf{39}_a$ of blade plate 37 intended for the ingot butt 42 is longer than the blade 39 adjacent to the container 18. Blade 39 slides along a contact strip $\mathbf{50}_a$.

Figure 14:
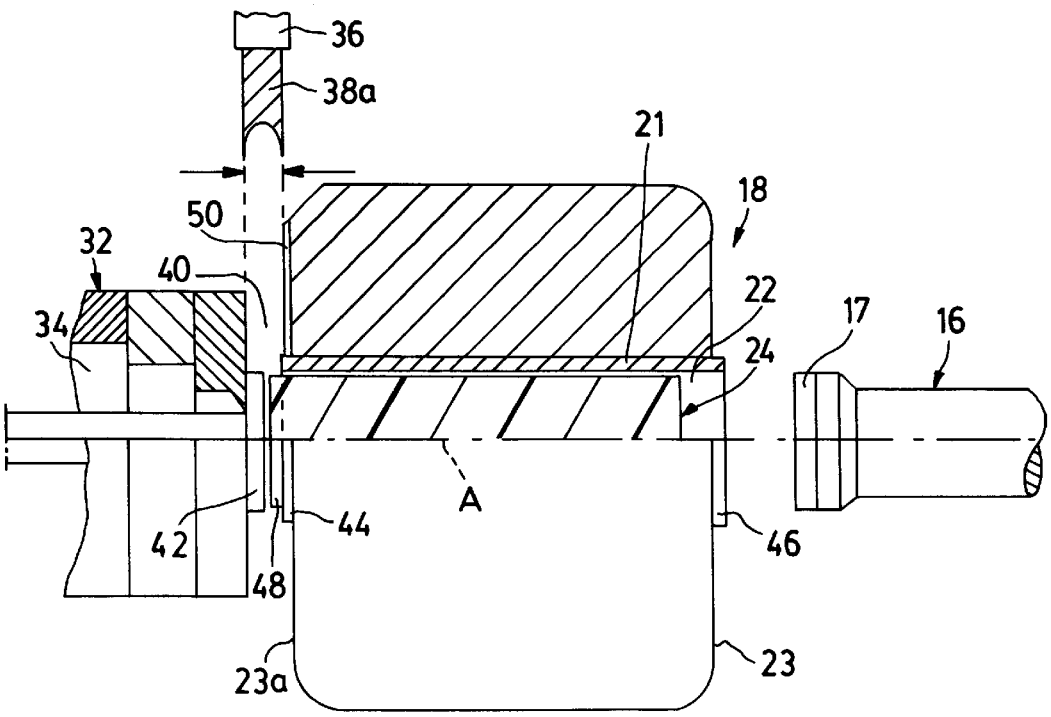

In the exemplified embodiment in FIG. 14, the ingot butt 42 and the ingot front end face 49 remain close to each other so that the breadth i of the shearing tool $\mathbf{38}_a$ may be kept very small. Consequently, there is an extremely small distance between the new oxide-free ingot end, created by removing the end slice 48, and the section end which is simultaneously freed from the ingot butt 42.

After the shearing operation is complete, the container 18 is again advanced to the die 32 and the extrusion process can begin again from the start.

Figure 16:
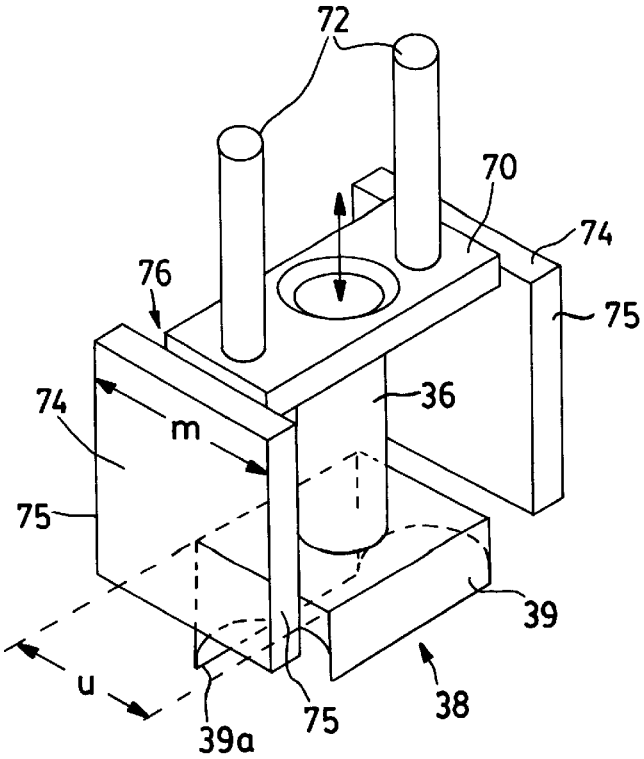

FIG. 16 shows a double bladed shearing tool 38 of breadth $i_1$, the driving ram 36 of which passes through a rectangular yoke 70 with some room for play; the yoke 70 is in turn mounted securely on jacking rods 72 and at both ends is provided a stop plate or spacer plate 74 of breadth m; the latter is slightly larger than the breadth $i_1$ of the double shear tool 38. This spacer facility 76 comprising yoke 70, jacking rods 72 and spacer plate 74 is lowered into the gap 40 between the container 18 and the die 32 to determine their effective distance from each other, whereby the long edges 75 of the spacer facility 76 running transverse to the direction of extrusion x form stops. The spacer facility and double bladed shearing tool 38 can be moved up and down, independent of each other, by a drive mechanism not shown here.

Figure 17:
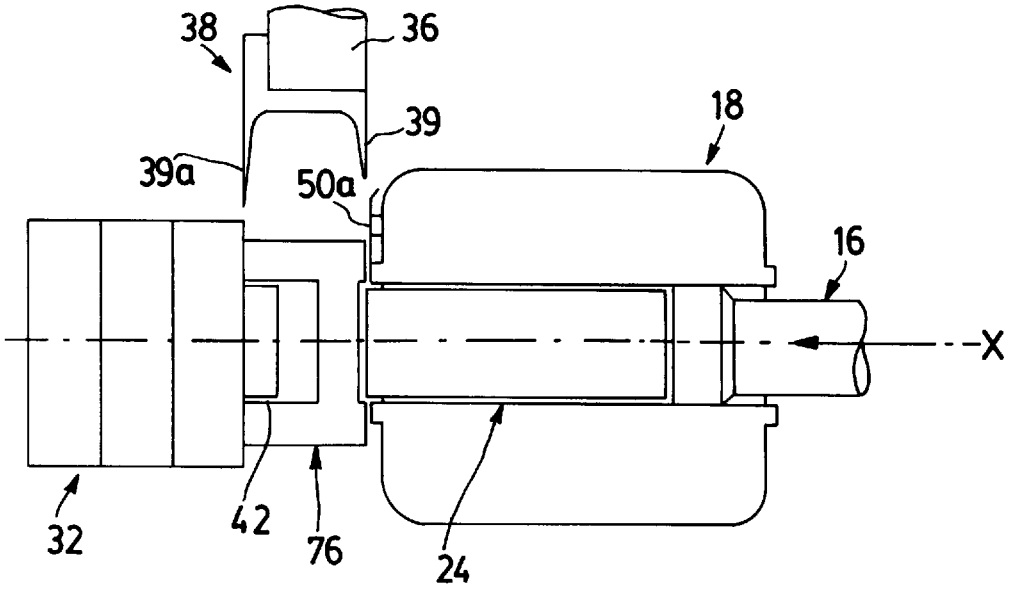
Figure 18:
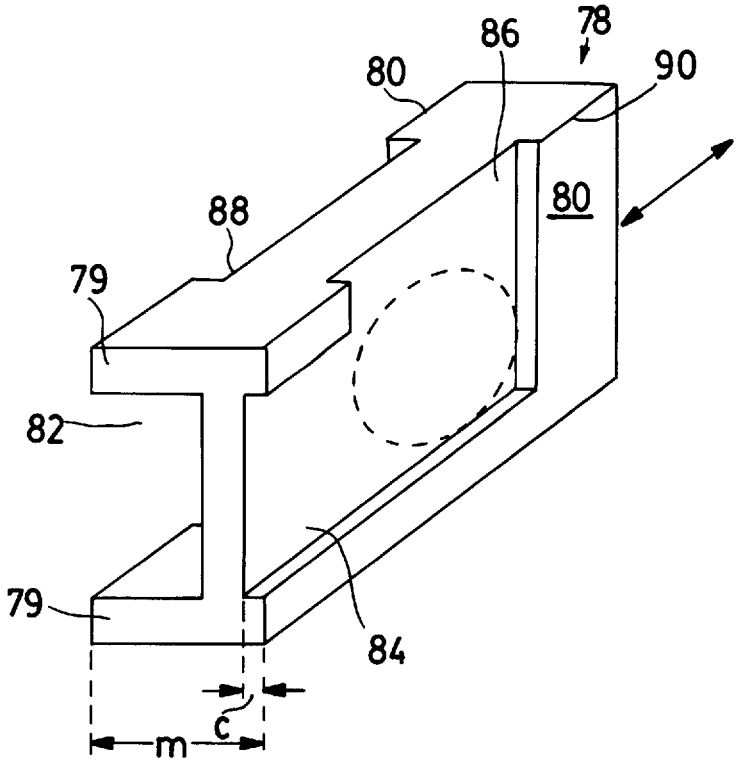

Likewise, a channel-shaped section 78 (FIGS. 17–18), which is open at both ends and is pushed in, e.g., from the side, serves as a positioning stop and is employed to fix the distance n or the width of the gap 40. The cross-sectional length m of the flanges 79 on the channel-shaped section 78 determine the above mentioned gap width n.

In the operating position, the flanges 79 flank the ingot butt which then stands in the inner part of the section or channel 82 which is delimited on the other side by the section base 80. In the direction towards the container 18 a flat recess 84 of depth e of about 10 mm is provided in the section base 80. This recess 84 is for the front end slice 48 of the ingot; it is open towards the shearing blade 39 in order that this can be lowered through the edge slit 86 onto the end slice 48. The interior 82 of the section is also provided with an access opening 88 for the other shearing blade $\mathbf{39}_a$. Both access slits 86, 88 lie on opposite sides and aligned with each other on the upwards lying long edge 90 of the channel-shaped section 78.

What is claimed is:

1. Device for extruding a section or the like body from an ingot, which comprises:

a container having a container end and a bore therein, wherein the ingot is introduced into the bore and exits at the container end;

a die downstream of the container having a shape-giving opening therein, with the container end facing the die opening and with a gap between the die and the container end;

an extrusion stem for feeding the ingot in the direction of extrusion (x) into the shape-giving opening in said die for the purpose of extrusion;

a spacer facility provided in said gap which can be advanced into and retracted from said gap transverse to the extrusion direction (x) and the die and container may be laid up against said spacer; and a movable shearing blade means arranged over the container end.

2. Device according to claim 1, wherein the spacer facility includes at least one stop plate with edges thereof, wherein said stop plate runs in the direction of extrusion (x), is arranged transverse to the direction of extrusion, and acts as stops for the die and container.

3. Device according to claim 2, including two of said stop plates joined by at least one yoke, and including a drive means operatively associated with said yoke.

4. Device according to claim 3, wherein said drive means is a movable set of rods.

5. Device according to claim 3, wherein said stop plates flank said shearing blade means.

6. Device according to claim 4, wherein said shearing blade means has a width and is mounted on said rods, and wherein the stop plates have a width, with the width of the stop plates corresponding approximately to the width of the shearing blade means.

7. Device according to claim 6, wherein the shearing blade means contains at least two shearing blades.

8. Device according to claim 4, wherein said rods pass through said yoke with room for play.

9. Device according to claim 1, wherein said spacer facility and shearing blade means are movable independent of each other.

10. Device according to claim 1, including two shearing blades running in the same direction a distance apart from each other, wherein said blades are different in length.

11. Device according to claim 10, wherein a first of said blades is adjacent the die and a second of said blades is adjacent the container, wherein said first blade is longer than said second blade.

12. Device according to claim 1, wherein said shearing blade is operative to remove a butt end of a previous ingot and a projecting length of said ingot.

13. Device according to claim 1, including alignment means on the container end to align the shearing blade means.

14. Device according to claim 1, wherein the container is relatively movable towards said die for extrusion and away from said die to obtain said gap for said spacer facility.

15. Device for extruding a section or the like body from an ingot, which comprises:

a container having a container end and a bore therein, wherein the ingot is introduced into the bore and exits at the container end;

a die downstream of the container having a shape-giving opening therein, with the container end facing the die opening and with a gap between the die and the container end;

an extrusion stem for feeding the ingot in the direction of extrusion (x) into the shape-giving opening in said die for the purpose of extrusion;

a spacer facility provided in said gap which can be advanced into and retracted from said gap transverse to the extrusion direction (x) and the die and container may be laid up against said spacer;

a movable shearing blade means arranged over the container end; and wherein the spacer facility includes a channel shaped section with ends, flanges and a base, wherein the channel shaped section is open at least at one end and its base acts as stops for the die and container, said flanges in cross-section running parallel to the direction of extrusion (x).

16. Device according to claim 15, wherein in the operating position said flanges touch both sides of the ingot butt at the die.

17. Device according to claim 15, wherein the base has an outside and the outside of the base features a recess to accommodate an end slice of the ingot facing the direction of extrusion.

18. Device according to claim 17, wherein said section has an interior and the recess is open at one end and runs parallel to the interior of the section to an open end of the section.

19. Device according to claim 18, wherein the section has a long edge, wherein an access opening is provided for the shearing blade means at the interior of the section and at the recess, and two access openings are arranged on opposite sides and aligned with each other on the long edge of the section.

* * * * *